US009874412B2

(12) United States Patent
Cummins

(10) Patent No.: US 9,874,412 B2
(45) Date of Patent: Jan. 23, 2018

(54) REINFORCED CROSS DRILLED BLOCK

(71) Applicant: Ronald Keith Cummins, LaGrange, KY (US)

(72) Inventor: Ronald Keith Cummins, LaGrange, KY (US)

( * ) Notice: Subject to any disclaimer, the term of this patent is extended or adjusted under 35 U.S.C. 154(b) by 56 days.

(21) Appl. No.: 15/011,508

(22) Filed: Jan. 30, 2016

(65) Prior Publication Data

US 2016/0238330 A1 Aug. 18, 2016

Related U.S. Application Data

(60) Provisional application No. 62/113,499, filed on Feb. 8, 2015.

(51) Int. Cl.

| | |
|---|---|
| ***F28F 13/18*** | (2006.01) |
| ***F28F 19/04*** | (2006.01) |
| ***F28F 21/02*** | (2006.01) |
| ***F28F 7/02*** | (2006.01) |
| ***F28F 9/02*** | (2006.01) |
| ***F28D 7/16*** | (2006.01) |
| *F28D 21/00* | (2006.01) |

(52) U.S. Cl.

CPC ..... *F28F 19/04* (2013.01); *F28D 7/16* (2013.01); *F28F 7/02* (2013.01); *F28F 9/02* (2013.01); *F28F 21/02* (2013.01); *F28D 2021/0022* (2013.01)

(58) Field of Classification Search

CPC ..... F28F 19/04; F28F 7/02; F28F 9/02; F28F 21/02; F28F 3/00; F28F 9/0229; F28F 21/062; F28F 21/086; F28F 21/04; F28D 7/16; F28D 2021/0022; F28D 7/1615

USPC ..... 165/133

See application file for complete search history.

(56) References Cited

U.S. PATENT DOCUMENTS

| | | | | |
|---|---|---|---|---|
| 2010/0314081 | A1* | 12/2010 | Reis | F24J 2/07 165/134.1 |
| 2015/0122244 | A1* | 5/2015 | Bain | F24J 2/07 126/643 |
| 2016/0146549 | A1* | 5/2016 | Schneweis | C04B 35/522 165/185 |

FOREIGN PATENT DOCUMENTS

| | | | |
|---|---|---|---|
| CN | 2585166 | 11/2003 | |
| CN | 202255066 | 5/2012 | |
| EP | 0744587 | * 11/1996 | F28F 21/02 |

* cited by examiner

*Primary Examiner* — Davis Hwu

(74) *Attorney, Agent, or Firm* — Patrick Dean Cummins

(57) ABSTRACT

This application relates to graphite heat exchangers having a graphite block with graphite tubes disposed within the graphite block. The graphite tubes can include a coating that is cured in order to plasticize the coating and make the graphite tubes more corrosion resistant. The graphite block and the graphite tubes can be impregnated with a phenolic resin for improving the rigidity and structural integrity of the graphite block and the graphite tubes. The coating surrounding the graphite tubes can be a Teflon based coating, such as Tefzel, which can improve the durability of the graphite heat exchanger. The graphite tubes can be prepared by first coating the graphite tubes with the coating material and then curing or baking the graphite tubes in order to plasticize or otherwise cure the coating material.

20 Claims, 5 Drawing Sheets

REINFORCED CROSS DRILLED BLOCK

CROSS-REFERENCE TO RELATED APPLICATIONS

The present application claims the benefit of U.S. Provisional Application No. 62/113,499 entitled "REINFORCED CROSS DRILLED BLOCK" filed Feb. 8, 2015, the content of which is incorporated herein by reference in its entirety for all purposes.

FIELD

The described embodiments relate generally to heat exchangers. More particularly, the present embodiments relate to cross drilled block heat exchangers having coated reinforced tubes and a reinforced block.

BACKGROUND

Heat exchangers can contact a variety of chemicals when installed into a manufacturing process. Such chemicals may be corrosive to parts of the heat exchanger and eventually ruin some of the functionality of the heat exchanger over time. For example, certain metals and non-metals on the heat exchanger can corrode as a result of process flow through the heat exchanger. As many new chemicals become important for manufacturing certain products, many manufacturing processes need to be updated and improved in order to provide a manufacturing system that does not fail as a result of material corrosion.

SUMMARY

This paper describes various embodiments that relate to graphite heat exchangers. In some embodiments, a graphite heat exchanger is set forth as having a heat exchanger block comprising a first set of apertures and a second set of apertures that are substantially perpendicular to the first set of apertures. The graphite heat exchanger can also include a set of tubes positioned at least partially within the first set of apertures, and a coating covering a portion of an outer surface of one or more tubes of the set of tubes and an inner surface of one or more apertures of the first set of apertures. The heat exchanger block can be a resin impregnated graphite block. Furthermore, the graphite heat exchanger can include a cap that is coupled to one or more sides of the heat exchanger block. The cap can include a set of cap apertures, wherein at least two tubes of the set of tubes extend at least partially into two cap apertures of the set of cap apertures. An interior surface of the at least two cap apertures can be coated with the coating. The coating can be a cured Teflon-based coating, and a tube of the set of tubes can include lateral end surfaces that include the coating. Furthermore, each cap aperture of the at least two cap apertures can include a first radius that is at least equal to an outer radius of a tube of the set of tubes, and a second radius that is less than the outer radius of the tube of the set of tubes. Additionally, a tube of the set of tubes can extend from out of an aperture of the first set of apertures at opposing ends of the heat exchanger block, and portions of the tube extending from the opposing ends can include the coating. The tubes can be made from graphite, ceramic, tantalum, titanium, and/or any material that can withstand high temperatures and/or corrosive chemicals.

In other embodiments, a method is set forth for assembling at least a portion of a heat exchanger that includes a graphite block and graphite tubes. The method can include steps of receiving a graphite tube that includes a coating on an exterior surface of the graphite tube, and receiving a graphite block that includes an aperture extending through the graphite block. The method can further include positioning the graphite tube at least partially within the aperture of the graphite block such that the coating abuts an interior surface of the graphite block that at least partially defines the aperture. Additionally, the method can include applying the coating to the graphite tube, wherein the coating is a Teflon-based coating, and baking the graphite tube with the coating to cause the coating to plasticize the coating. The method can further include coating the graphite block with resin after positioning the graphite tube at least partially within the aperture of the graphite block, placing the block of graphite into a chamber, and reducing pressure in the chamber in order to cause the resin to enter pores of the block of graphite. Furthermore, the method can include coating at least a portion of a cap that includes an aperture having at least two radii, and positioning the cap onto a surface of the graphite block such that at least a portion of the graphite tube extends into the aperture of the cap. Additionally, the method can include baking the graphite block after positioning the graphite tube at least partially within the aperture of the graphite block, and performing an impregnation process on the graphite block to force a resin into the pores of the graphite block.

In yet other embodiments, a system is set forth as having a graphite block comprising (i) pores that are impregnated with a resin and (ii) process apertures extending through the graphite block. The system can further include tubes at least partially disposed within the process apertures of the graphite block, the tubes comprising a coating disposed over curved exterior surfaces of the tubes. Furthermore, the system can include a graphite cap disposed over a portion of the tubes at an end of the graphite block, the graphite cap comprising openings, wherein at least one opening of the openings includes the coating and the coating seals an area between the graphite cap and at least one tube of the tubes. In some embodiments of the system, the at least one opening of the openings can include a first portion having a first radius and a second portion having a second radius that is smaller than the first radius, and at least one of the first portion and the second portion can include the coating. Furthermore, the graphite cap can be impregnated with the graphite resin, and the coating on the graphite cap can be a cured Teflon based coating. Additionally, the coating on the tubes can be a cured Tefzel coating that is disposed between surfaces defining the process apertures of the graphite block and the curved exterior surfaces of the tubes. In some embodiments, the graphite block can include fluid apertures extending through the graphite block and between the process apertures and the coating on the tubes is a cured Teflon based coating. The tubes can be made from graphite, ceramic, titanium, tantalum, metal alloy, and/or any material that resist corrosion from process chemicals.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
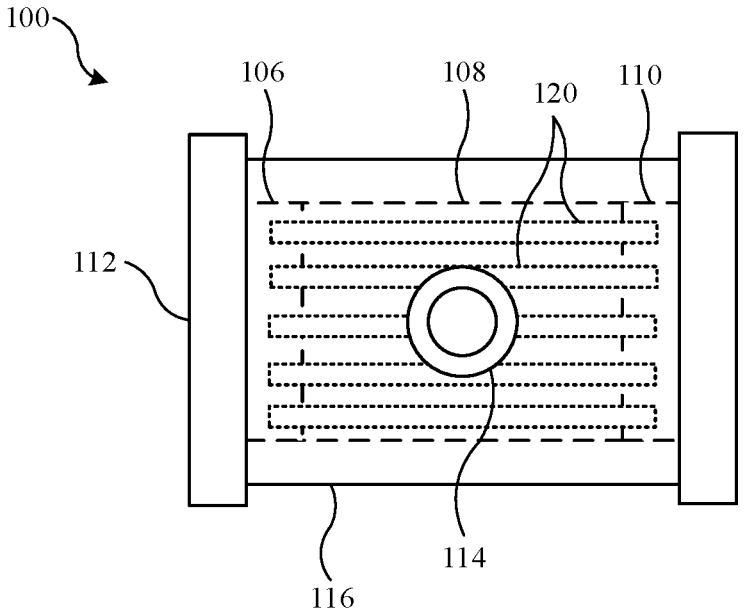
FIGS. 1A and 1B illustrate hidden views of a heat exchanger that includes a reinforced cross drilled heat exchanger block with coated tubes disposed within the reinforced cross drilled heat exchanger block.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The described embodiments relate to heat exchangers that are reinforced by material and structural enhancements, which allow the heat exchangers to withstand exposure to heat and chemicals that may cause other heat exchangers to fail. In some embodiments, a graphite block is drilled to have process flow apertures and fluid flow apertures. Inside the process flow apertures and/or the fluid flow apertures, tubes can be inserted. The tubes can be made from graphite and coated with a protective material in order to make the tubes more resistant to corrosion from fluids moving through the tubes. For example, the tubes can be coated with a Teflon based coating such as Tefzel. The Teflon based coating can be plasticized through a heat treating or curing process before the tubes are inserted into the graphite block. For example, the curing process can include coating the graphite tubes with a Tefzel coating and raising the temperature of the graphite tubes to at least 400 degrees Fahrenheit. The curing process can occur when the tubes are not disposed within the graphite block. In some embodiments, the curing process can occur when the tubes are disposed within the graphite block but before impregnation of the graphite block. Once the coating has been cured and the graphite tubes have been inserted into the graphite block, a cap can be placed on one or more ends of the graphite block. Thereafter, a seal can be created between the cap and the graphite block by impregnating the graphite block and the cap together with a resin, such as a phenolic resin or carbon based resin. Impregnating the graphite block and the graphite cap can be accomplished by coating the cap and the graphite block with the resin and placing the coated cap and the coated graphite block in a vacuum. Alternatively, the cap and the graphite block can be sealed using a silicon or Teflon glue, which can be disposed between the cap and the graphite block.

The cap can be made of graphite and include cap apertures for receiving ends of the tubes when the tubes are inserted into the graphite block. The cap apertures can be characterized has having on or more radii. For example, the cap apertures can have a first radius that is larger than the second radius. The second radius can be smaller than a radius of the tubes, in order that a portion of the cap apertures will abut the ends of the tubes, but allow the tubes to at least partially extend into the cap apertures when the cap is placed onto the tubes and the graphite block. A surface that defines the cap apertures can be coated with the same coating as the coating that is on the tubes, in order to create an additional seal between the tubes and the cap. Once the cap is placed on the graphite block such that the tubes extend at least partially into the cap apertures that include the coating, the resulting assembly can be baked in order to cure the coating on the cap apertures. In some embodiments, two caps are attached to the graphite block, however, it should be noted that additional caps can be attached to the graphite block in order to provide an adequate seal for the graphite block. Once the cured graphite tubes have been placed into the graphite block, and the cap has been cured while attached to the graphite block, the resulting graphite block assembly can be impregnated with a resin such as a phenolic resin or carbon based resin. For example, the graphite block assembly can be coated with a phenolic resin and thereafter placed into a vacuum chamber. As a result of vacuum being applied to the vacuum chamber, the phenolic resin will advance into the pores of the graphite block, thereby strengthening the graphite block. The final product can be referred to as a reinforced cross drilled heat exchanger block (RCDB).

RCDBs have many applications in heating and cooling fluids in manufacturing of at least chemicals, metals, food products, and pharmaceuticals. Treatment of gases in evaporation or environmental applications are also other examples. The list of applications is substantial as industries continue to make materials in manufacturing or change the properties of elements. RCDB's have the effectiveness of taking up less space and being more compact than the widely used shell and tube exchangers and/or boilers. The heat exchanger block can be in the shape of varied geometrical shapes but the some popular shapes are rectangular, square, cylindrical, round, and cubic. The capacity of a RCDB is determined by the number of apertures drilled in its material. Capacity is determined by area of the drilled apertures that the product fluids will run through. The area of the drilled apertures can be converted to square feet for determining capacity in square feet.

The determination of suitable size for an application of a RCDB can be performed by determining the right material to handle the product and the heat transfer of the material itself. Finding the right material of a RCDB is critical as certain fluids will either corrode or produce contamination to fluids. The effectiveness of RCDB is determined by the strength and heat transfer of the wall between two running fluids. One side of the block (for example, a radial side side when the side of the block is a cylinder, or a lateral side when the side of the block is flat) can receive a heating or cooling medium. Another side, the axial side, can receive a product fluid that will be heated or cooled. However, in some embodiments of the RCDB, the radial side can receive a product fluid and the axial side can receive a heating or cooling medium. Previously, heat exchanger blocks failed because of the permeation of fluids leaving one side of the block and going through the wall of material separating the two different fluids. Many factors can play in to this permeation of fluids leaving one side and joining another side, such as time and use of the heat exchanger block, which contributes to corrosion.

As discussed herein, binders can be used to reinforce graphite and mitigate or prevent corrosion. Such binders include, but are not limited to Teflon adhesives, silicone resins, phenolic resins or graphite cements. Binders can also be in the form of a spray on coating such as Tefzel, Kynar, and/or Halar. These spray binders can use be baked at a high temperature to adequately reinforce the tubes and/or bock, and bind to a graphite block. Factors in selecting a binder (i.e., a coating) for an RCDB can include: (i) resistance of the binder to breaking down through temperature or erosion. This can also mean taking in to account material that is not reactive to the product or fluids being run opposite of the RCDB; (2) whether the binder is a viscous material that does not allow leaks or permeation from one side of the RCDB to the other side of the RCDB; and (3) whether the binder is an adhesive or coating that will not cause air pockets between the RCDB and the inserted tube. By selecting one or more binders for an RCDB based on these factors, erosion can be mitigated and/or prevented through the application of one or more binders or coatings to one or more tubes incorporated into an RCDB.

These and other embodiments are discussed below with reference to FIGS. 1A-5; however, those skilled in the art will readily appreciate that the detailed description given herein with respect to these figures is for explanatory purposes only and should not be construed as limiting.

Figure 1B:
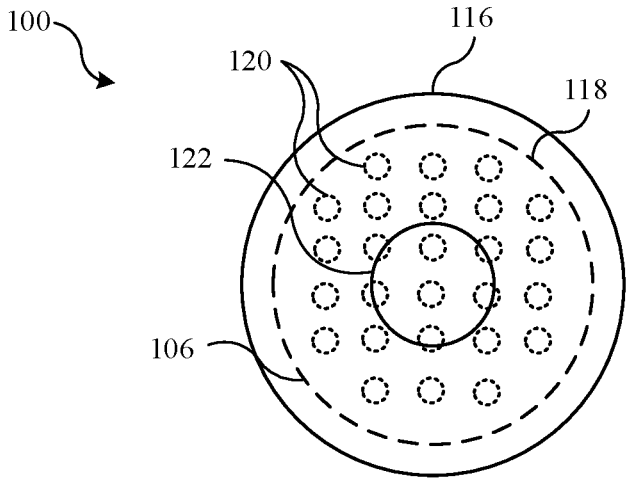

FIG. 1A illustrates a side hidden view of a heat exchanger 100 that includes a cross drilled block that includes cured tubes and a resin impregnated block, as discussed herein. Specifically, the heat exchanger 100 includes a process side 112 for receiving a process fluid that is to be heated or cooled as it passes through the heat exchanger. Additionally, the heat exchanger 100 includes a fluid opening 114 receiving a fluid, such as steam, for heating or cooling the process fluid moving through the heat exchanger 100. The heat exchanger 100 can further include a housing 116 for containing a heat exchanger block 108, such as the cross drilled block discussed herein, and the caps 106 and 110. The caps 106 and 110 are connected to opposing sides of the heat exchanger block 108 and seal a connection between the process sides 112 and tubes 120 disposed within the heat exchanger block 108. The tubes 120 can include a cured Teflon based coating, such as Tefzel, for reinforcing the tubes 120 and reducing corrosion of the tubes 120. FIG. 1B illustrates a front hidden view of the heat exchanger 100. Specifically, FIG. 1B illustrates a process opening 122 in the process side 112 of the heat exchanger 100. Once a process fluid enters the process opening 112, the process fluid will then enter the cap 106 and then the tubes 120 within the heat exchanger block 108. The process fluid flows through an axial side of the heat exchanger block 108, which corresponds to the process side 112, and the fluid moving through the fluid opening 114 will move through a radial side of the heat exchanger block 108. The heat exchanger block 108 (also referred to as a cross drilled block throughout this paper) can include numerous apertures that traverse different sides of the heat exchanger block 108. In some embodiments, some of the apertures extend perpendicular with respect to each other. However, angles between apertures can be any suitable angle for optimizing heat transfer of fluids flowing through the cross drilled block. This is accomplished by drilling rows of apertures that are substantially equally, or not equally, spaced in some embodiments. The aperture spacing can be substantially uniform and the wall of the apertures can be referred to as webs. If the drilling is done correctly and water was to be poured into each aperture with a stopper at the end of the aperture, the water would not migrate between apertures but remain exclusively in individual apertures. The distance between each aperture in each row of apertures is determined by the drilled apertures drilled on a radial and/or an axial side of the heat exchanger block 108. The number of drilled apertures can be based on a surface area of the radial or axial side of the heat exchanger block 108. These apertures are drilled to miss the axial or radial apertures running down from the top to bottom of the heat exchanger block 108. All or some of the axial apertures and the radial apertures can be substantially equally spaced apart, or be spaced according to a non-equal spacing. Using axial and radial apertures drilled substantially equally spaced apart, the radial and axial aperture fluids will not intermingle.

In some embodiments, a PVC plastic can be included in the apertures of the heat exchanger block 108 to provide rigid material to run fluids through. For example, PVC plastic can be used inside of the apertures. If both sides of the apertures had water traversing the apertures, neither side would leak in to other apertures due to the rigid and dense material of PVC. If the axial side is receiving steam and the radial side is receiving water to be heated by the steam, the time it takes to raise the temperature of the water to a certain degree would depend on the thermal conductivity of PVC and what the area of the PVC is. Velocity, specific gravity, and other related variables also contribute to how quickly water could be heated in a time span. These would be concerns of production of hot water.

A concern with heated fluids in general is how long the PVC would last after being exposed to the heated fluids. In this case of PVC being used as heat transfer material with water, the life expectancy of the material would last indefinitely because there is no erosion of PVC to water. In the case of other materials and fluids this is not always the case. If the material of the block was graphite and the fluid material was steam on one side of the block and hydrofluoric acid on the opposing wall side, the erosion factor would be quick. In some embodiments, the steam is provided from a pipe having a carbon steel jacket under pressure to maintain constant pressure and temperature. Erosion will happen in the web separating the two materials and the acid will leak in to the steam chamber. This will cause the complete destruction of the carbon steel jacket and cause a steam leak to the atmosphere. In its make-up, graphite is a very porous material but effective in combating aggressive acids. The heat transfer value of graphite is very high compared to other materials and its ability to prevent erosion in webs of carbon blocks is greatly improved with impregnating the porosity of the graphite. Impregnation penetrates the viscous material and stops porosity. Depending on the material of impregnation, the acid resistances and material strength is improved. Different resins can be used to bind the grains of graphite and improve tensile and compressive strengths.

Figure 2:
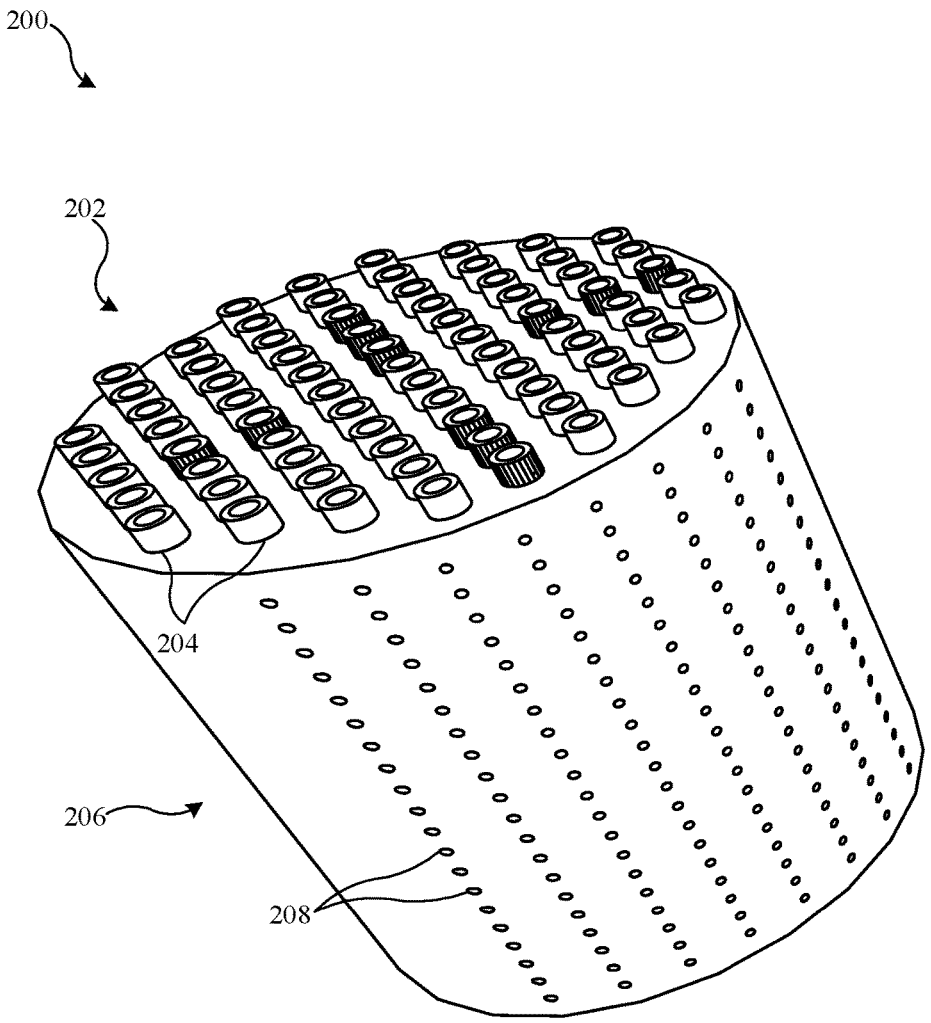
FIG. 2 illustrates a perspective view of a reinforced cross drilled heat exchanger block with coated tubes extended from a process side of the heat exchanger block.

FIG. 2 illustrates a perspective view of a heat exchanger block assembly 200, which is a reinforced cross drilled block, such as the heat exchanger block 108. The heat exchanger block assembly 200 can include coated tubes 204 extending through a process side 202. A coating on the coated tubes 204 can be a cured or plasticized coating. For example, the coating on the coated tubes 204 can be a Teflon based coating such as Tefzel which is sprayed onto the tubes and cured before or after the coated tubes 204 are disposed inside of the apertures of the heat exchanger block assembly 200. However, any suitable binder can be used as the coating on the tubes. A fluid side 206 of the heat exchanger block assembly 200 includes fluid apertures 208 for steam or other fluid to pass through and alter a temperature of a process fluid passing through the coated tubes 204. The coating can be on the radial outer surface of one or more tubes of the coated tubes 204, as all as on the later sides (i.e., the ends) of the coated tubes 204 in order to provide a binding agent between the coated tubes 204 and a cap, as discussed herein.

In the case of cured Tefzel coatings, a clearance of approximately 0.06 inches between the tubes outside dimension and the inside dimension of the process side apertures gives enough adhesive strength to hold the tube and stop permeation between the axial and radial apertures of the heat exchanger block assembly 200. However, in some embodiments, the clearance can be greater than or less than 0.06 inches. Before assembly of the heat exchanger block assembly 200, the inside surfaces of some of the heat exchanger block apertures and/or the outside surfaces of the tubes can be thoroughly wetted with the adhesive, resin, and/or coating. After the wetting and/or cementing of the tubes and/or block, the tubes and/or the block are cured. The process of curing can be performed through any suitable process for curing heat exchanger blocks and/or tubes. Furthermore, the steps of the curing process can be determined based on specifications from a manufacturer of the resin, adhesive or coating used to coat the tubes and/or block. In some embodiments, the curing process can include baking the tubes and/or block at a high temperature in order to transform one or more properties of the coatings applied to the tubes and/or block. After curing, inspection should be made of the parts (block and tubes) to determine if any flaws developed as a result of the curing process. Some of the flaws can be fisheye (appearance of boiling in the bonding material), pitting (open trails or lack of bonding material between block and tube and spill over (appearance of boiled out material between tube and block).

Figure 3A:
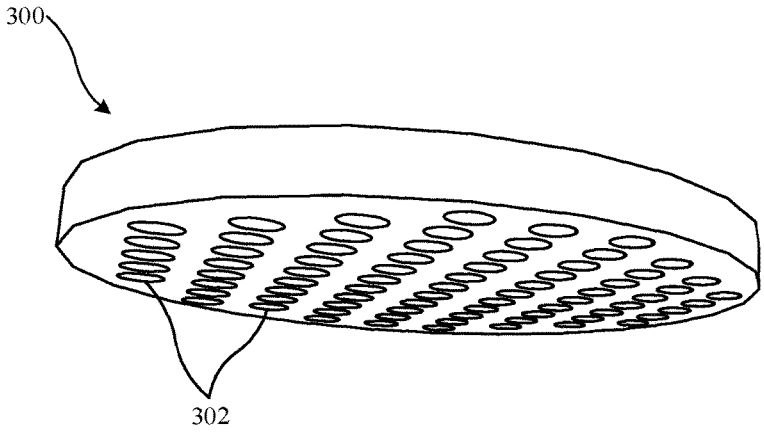
FIGS. 3A and 3B illustrate perspective views of a cap that can be attached to the process side of the heat exchanger block of FIG. 2.
Figure 3B:
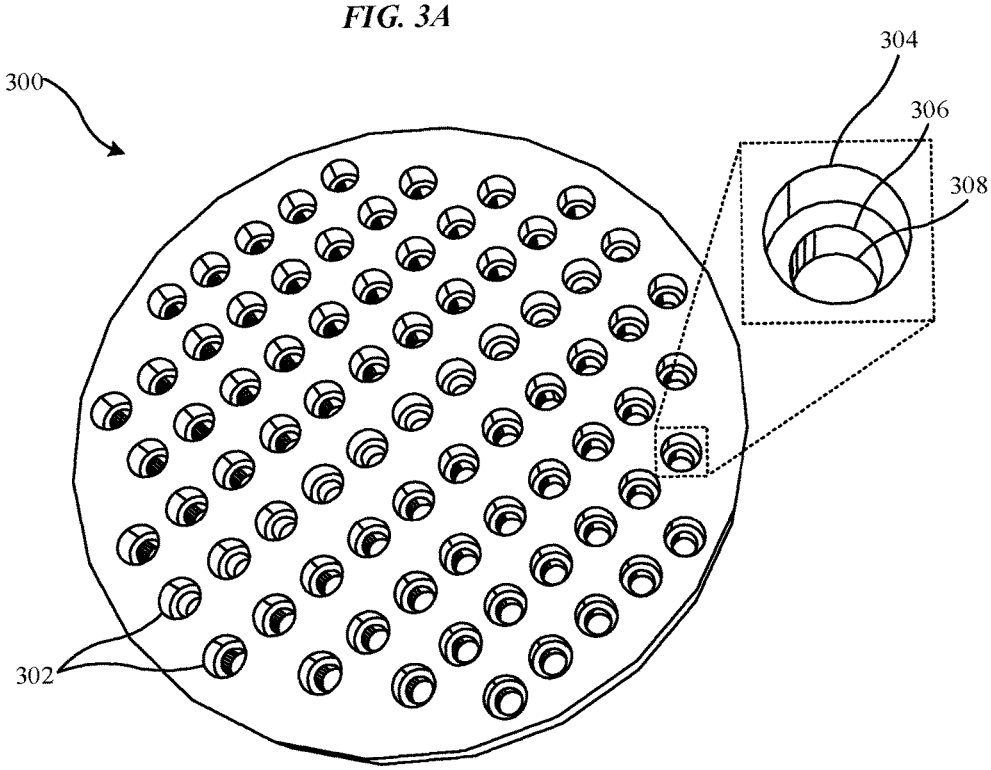

FIG. 3A illustrates a perspective view of a cap 300 that can be attached to any of the heat exchanger blocks discussed herein. The cap 300 can include one or more aperture 302 for a process fluid to move through. The apertures 302 can also be used for receiving tubes that are extending from a heat exchanger block, such as the coated tubes 204 from the heat exchanger block assembly 200 illustrated in FIG. 2. The apertures 302 can be drilled through the cap 300 such that a single radius defines a radius of an aperture of the apertures 302. In some embodiments, the apertures can by drilled such that at least two radii define the radii of an aperture of the apertures 302, as illustrated in FIG. 3B. In other words, the apertures can have a stepped opening such that one or more of the coated tubes 204 can abut a surface of the stepped opening. FIG. 3B illustrates another perspective view of the cap 300 having apertures 302 with stepped openings 306. The apertures 302 can be defined by a first opening 304 having a first radius and a second opening 308 having a second radius. The first radius can be bigger than the second radius, and the second radius can be smaller than an outer most radius of a tube of the coated tubes 204. The cap 300 can be made from graphite or impregnated graphite, and the coated tubes 204 can also be made from at least graphite or impregnated graphite. Each stepped opening 306 of the apertures 302 can be coated in order to seal an area between the cap 300 and the coated tubes 204. The coating on the stepped opening 308 can be a Teflon based coating such as Tefzel. The Tefzel coating on the stepped openings 308 can be applied to the cap 300 can thereafter cured or baked in order to plasticize the Tefzel coating. Thereafter, a cap 300 can be attached to the heat exchanger assembly 200 at each axial side of the of the heat exchanger assembly 200 and the heat exchanger assembly 200 can be secured inside a housing to provide a fully assembled heat exchanger. In some embodiments, a cement or resin can be applied to the stepped openings 306 before the cap 300 is attached to the heat exchanger assembly 200. Thereafter, the cement or resin (e.g., a graphite resin or phenolic resin) can be baked in order to create a solid bonding layer between the coated tubes 204 and the stepped openings 306. In some embodiments, multiple heat exchanger assemblies 200 can be stacked together and separated by a gasket or cap. This embodiment can be useful in builds where multiple heat exchanger blocks need to be stacked together for a particular process.

In some embodiments, the heat exchanger assembly 200 can include non-impregnated material, and can rely on glue and/or coatings to stop permeation between the product fluids and water/steam side (radial and axial side, respectively; or axial and radial side, respectively). In other embodiments, the heat exchanger assembly 200 can include impregnated blocks or solid non-permeating blocks as the base material for porous (e.g., graphite) tubes to be glued or cemented into. When using a solid base block, two materials are stopping the permeation. One material is the cement or coating holding the tube in and the second material is the impregnated block. In yet other embodiments, the heat exchanger assembly 200 can include impregnated/solid base materials with impregnated and/or coated tubes that are substantially impervious. Typical uses for materials that are both impervious to the product being run through the heat exchanger assembly 200 are for better wear and durability in corrosive environments. Durability may also equate to achieving higher tensile, compression strengths and chemical strength.

The heat exchanger assembly 200 can incorporate a solid tube/impregnated tube with a un-impregnated heat exchanger block. Typical requirements for non-impregnated block are low pressure services and low corrosive environments. When a tube is introduced as the impervious part of a heat exchanger assembly 200, more emphasis must be put in the tube and coating. A higher percentage of failure will follow after the erosion of the tube and cement/coating of the core block.

Figure 4:
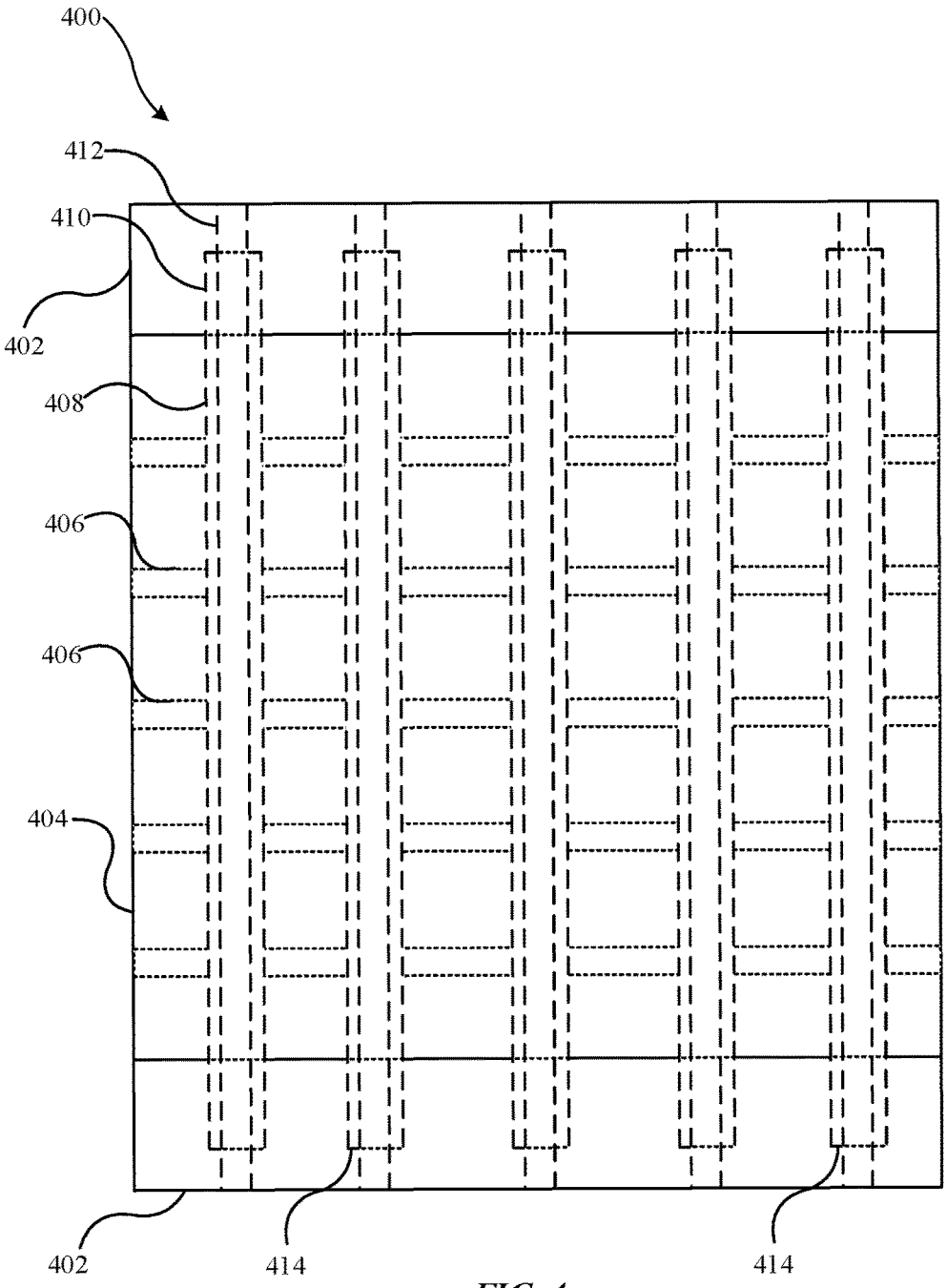
FIG. 4 illustrates a heat exchanger block assembly that includes (i) a heat exchanger block with coated tubes at least partially disposed within the heat exchanger block and (ii) caps attached to opposing ends of the heat exchanger block.

FIG. 4 illustrates a cross-sectional view of a heat exchanger assembly 400. The heat exchanger assembly 400 includes at least two caps 402 on opposing sides of a heat exchanger block 404. The heat exchanger block 404 can be a cylindrical block, a cubic block, or a rectangular block. Furthermore, it should be noted that the heat exchanger assembly 400 can include and/or include any of the features discussed herein (such as the heat exchanger assembly 200). The heat exchanger assembly 400 can include one or more impregnated or non-impregnated tubes 408 that extend perpendicular to one or more fluid apertures 406. The fluid apertures 406 pass between the tubes 408 in order to heat the tubes when steam or other heated fluid is passed through the fluid apertures 406. Each cap 402 can include one or more first openings 412 and one or more second openings 410. The first openings 412 can have a smaller radius than the second openings 410, thereby creating stepped openings 414 in the caps 402, keeping the tubes 408 secured within the heat exchanger block 404. A seal, such as a gasket, can be disposed between each cap 402 and the heat exchanger block 404. In some embodiments, a cement or resin is disposed between each cap 402 and the heat exchanger block 404 to seal the regions between the cap 402 and the heat exchanger block 404. In embodiments where the tubes 408 and the heat exchanger block 404 are made from non-impregnated graphite, the assembled heat exchanger assembly 400 can be impregnated with a resin. It should be noted that the resin can include a phenolic resin or carbon based resin, or any other resin or cement that can be used to impregnate graphite. In other embodiments where either the tubes 408 or the heat exchanger block 404 are made from non-impregnated graphite, the assembled heat exchanger assembly 400 can be impregnated with a phenolic resin.

When manufacturing the heat exchanger block 404, the product side apertures can have a diameter that is greater than a diameter of the tubes 408 inserted into the produce side apertures. Taking in the size aperture on the axial side or the radial side will determine how many apertures may be drilled in an area. There is also an advantage of using a stronger material in the tubes 408 and a lower strength material in the heat exchanger block 404 for economy. In either case, the same material can be used in the heat exchanger block 404 and tubes 408, or different materials can be used for the heat exchanger block 404 and tubes 408. If performance in heat transfer is important, materials should be calculated to insure proper heat transfer. Often different materials may cause an insulating effect to fluids if not properly determined.

Before or after the axial apertures are determined or laid out, the radial apertures must be determined. In the drilling of the radial apertures, a 1/16" distance or web can be between the axial and radial apertures with without breaking of the wall. Although in some embodiments, the distance between axial and radial apertures can be greater than or less that 1/16". Having an exposed tube on the radial side apertures increases the failure rate of the heat exchanger block 404. If it is determined the radial side apertures are to be the ones with the tubes being threaded with tubes, those apertures should be drilled 1/16" oversized to the outer diameter of the tube. Erosion may ensue when a break occurs in the web between the axial apertures and radial apertures.

Once the drilling is completed on both radial and axial side apertures, it is advised to inspect borings for smooth consistent walls. This will greatly improve the adhesion and insertion of the tube. After inspection, a determination is to be made on the length of the tube to be inserted into each aperture. Thereafter, the tube is inserted through the proper aperture. In some embodiments, a determination is made whether the tube will be capped off. In some embodiments the tubes and block are to be faced off and/or machined after the curing stage. In such embodiments, a portion of one or more tubes can be left sticking out on both sides of the block to have a smooth homogeneous appearance of the block and tubes after machining. When the tubes ends are to have a spray on acid or water resistant coating applied, a smooth layer on the tubes can be used to accept coatings. Coatings are a good way to reduce the exposure of the adhesives and resins to aggressive fluids, thereby reducing early failure. After machining the block on both the radial and axial side, the tubes can now be slid in with the resin or adhesive chosen.

Figure 5:
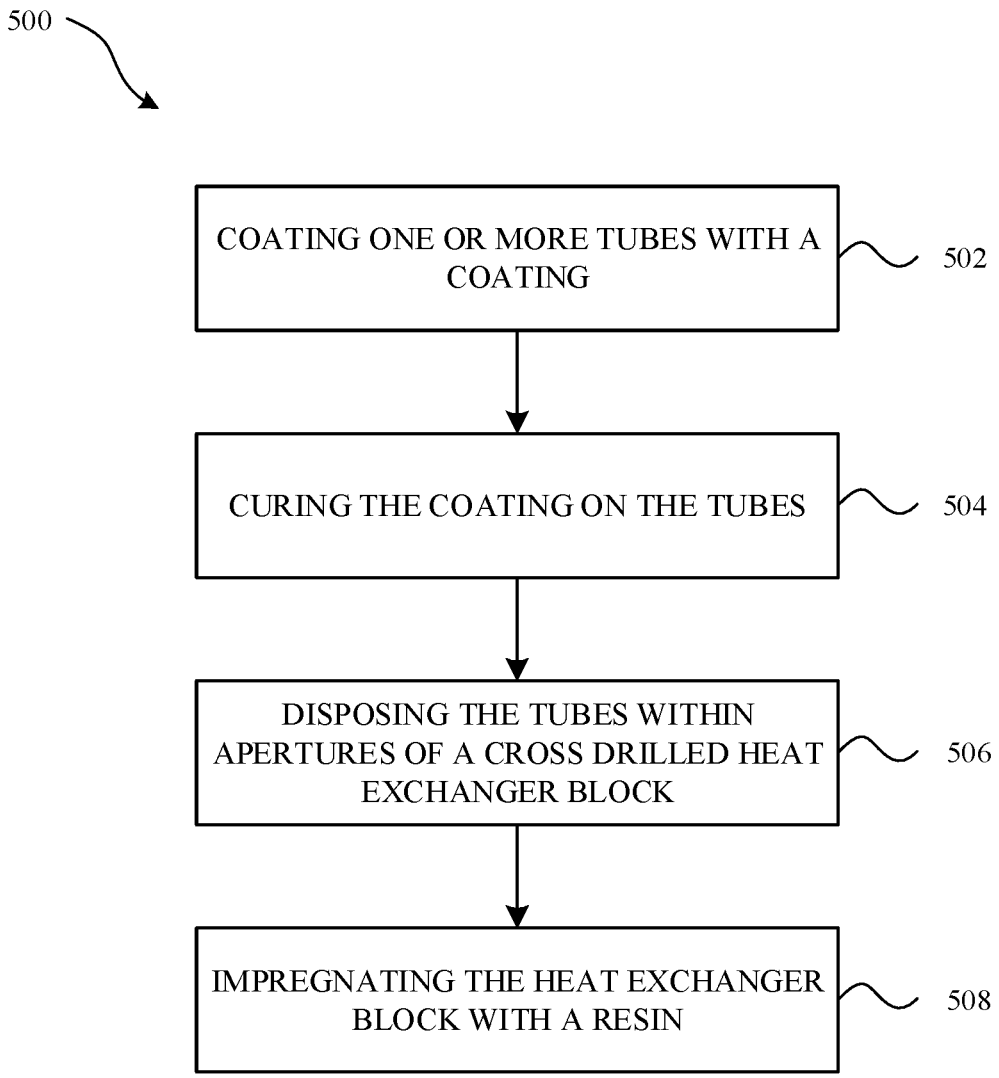
FIG. 5 illustrates a method for manufacturing a reinforced cross drilled heat exchanger block as discussed herein.

FIG. 5 illustrates a method 500 for manufacturing at least a portion of a heat exchanger that includes coated tubes. The method 500 can be performed by a person or apparatus, such as a computing device having a memory and one or more processors that execute instructions stored in the memory. The method 500 can include a step 502 of coating one or more tubes with a coating. The tubes can be graphite tubes that are impregnated with a resin or not impregnated with a resin. The coating can be a Teflon based coating, such as Tefzel, or any other protective coating that can be cured and plasticized through a baking process. The method 500 can further include a step 504 of curing the coating on the tubes. The coating can be cured by baking the coating or otherwise exposing the coating to high temperatures. For example, the tubes can be placed on a rack, sprayed with the coating, and the rack can then be placed into a chamber with an adjustable temperature. Thereafter, the temperature of the chamber can be raised to a temperature for curing the coating (e.g., 400 degrees Fahrenheit). At step 506, the tubes with the cured coating can be disposed within a cross drilled heat exchanger block. The cross drilled heat exchanger block can be a graphite heat exchanger block that includes apertures for different fluids to flow through. Furthermore, the graphite heat exchanger block can include apertures for inserting the coated tubes. At step 508, the graphite heat exchanger block is impregnated with a resin. The resin can be a phenolic resin that includes particles suitable for impregnating a graphite block. It should be noted that impregnating a material refers to a process of forcing an impregnating substance (such as a resin) into the pores of the material to be impregnated (such as a graphite block, as discussed herein). The impregnating process can include applying a vacuum to the graphite block while the graphite block is coated with the resin. The graphite block can thereafter be heated in order to ensure adequate permeation of the resin through the surface of the graphite block. It should be noted that method 500 can be modified to include more or less steps. Additionally, the method 500 can be modified to incorporate any features discussed within this paper. For example, the method 500 can be modified to incorporate different materials, different processes, and/or different steps.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A graphite heat exchanger, comprising:

a graphite heat exchanger block having a first set of apertures and a second set of apertures, wherein the first set of apertures are perpendicular to a second set of apertures and at least a portion of the graphite heat exchanger block is impregnated with a resin;

a set of tubes positioned at least partially within the first set of apertures;

a cured coating covering a portion of an outer surface of one or more tubes of the set of tubes; and a cap that is coupled to a side of the heat exchanger block and includes a set of cap apertures, wherein at least two tubes of the set of tubes extend at least partially into two cap apertures of the set of cap apertures.

2. The graphite heat exchanger of claim 1, wherein the resin is phenolic resin and the cured coating is a cured cement or resin.

3. The graphite heat exchanger of claim 1, wherein an interior surface of the at least two cap apertures are at least partially coated with the coating.

4. The graphite heat exchanger of claim 1, wherein the at least two tubes include ceramic tubes.

5. The graphite heat exchanger of claim 1, wherein the one or more tubes include lateral side surfaces, perpendicular to the outer surface of the tube, that also include the coating.

6. The graphite heat exchanger of claim 1, wherein the at least two cap apertures include (i) a first portion that includes a first radius that is at least equal to an outer radius of a tube of the set of tubes, and (ii) a second portion that includes a second radius that is less than the outer radius of the tube of the set of tubes.

7. The graphite heat exchanger of claim 1, wherein (i) a tube of the set of tubes extends from out of an aperture of the first set of apertures at opposing ends of the heat exchanger block, and (ii) a planar surface of the tube that extends from the opposing ends of the heat exchanger block includes the coating.

8. A heat exchanger, comprising:

a heat exchanger block that is impregnated with a phenolic resin, the heat exchanger block comprising a first set of apertures and a second set of apertures;

a set of tubes, wherein a tube of the set of tubes (i) includes a ceramic tube and (ii) extends through the first set of apertures of the heat exchanger block;

a cap that is connected to the heat exchanger block and includes a set of cap apertures, wherein the tube extends into a cap aperture of the set of cap apertures and is sealed to the cap with an adhesive.

9. The heat exchanger of claim 8, wherein the set of tubes extend at least partially out of opposing surfaces of the heat exchanger block.

10. The heat exchanger of claim 9, wherein the heat exchanger block and the cap are impregnated with a phenolic resin.

11. The heat exchanger of claim 10, wherein the adhesive is a cured adhesive that contacts the heat exchanger block, the ceramic tube, and the cap aperture.

12. The heat exchanger of claim 11, wherein set of cap aperture extend through the cap in a direction that is perpendicular to the second set of apertures.

13. The heat exchanger of claim 12, wherein a first radius of an inner portion of the cap aperture is less than an outer radius of the ceramic tube.

14. The heat exchanger of claim 13, further comprising:

a baked resin or a gasket disposed between the cap and the heat exchanger block, in a region through which the ceramic tube extends.

15. A heat exchanger, comprising:

a graphite block that is impregnated with a phenolic resin, the graphite block comprising a first set of apertures that extend perpendicular to:

(i) a second set of apertures of the graphite block, and (ii) opposing surfaces of the graphite block;

ceramic tubes that are disposed within the first set of apertures of the graphite block and extend at least partially out of each surface of the opposing surfaces of the graphite block;

a graphite cap that is impregnated with a phenolic resin, the graphite cap comprising a set of cap apertures that extend through the graphite cap, wherein a cap aperture of the set of cap apertures includes a first opening having a first radius and a second opening having second radius that is larger than the first radius; and a cured adhesive disposed within the second opening of the cap aperture, wherein the cured adhesive:

(i) contacts a ceramic tube of the ceramic tubes and the cap aperture, and (ii) seals a fluid pathway that extends through the cap aperture and the ceramic tube.

16. The heat exchanger of claim 15, wherein the graphite block and the graphite cap are cylindrical, and the set of cap apertures extend through the graphite cap in an axial direction.

17. The heat exchanger of claim 16, wherein the second radius is larger than a tube radius of the ceramic tube and the first radius is smaller than the tube radius of the ceramic tube.

18. The heat exchanger of claim 17, wherein the ceramic tube abuts a surface of the graphite cap between the first opening and the second opening.

19. The heat exchanger of claim 18, wherein the graphite block and the graphite cap are connected by a baked resin that is disposed between the graphite block and the graphite cap in a region through which the ceramic tube extends.

20. The graphite heat exchanger of claim 1, wherein a cross-section of the graphite heat exchanger block is rectangular, square, or round.

* * * * *